US010767301B2

(12) United States Patent
Terzian

(10) Patent No.: US 10,767,301 B2
(45) Date of Patent: Sep. 8, 2020

(54) SPIN CYCLE MOBILE WASHER

(71) Applicant: Talar Terzian, Gainesville, FL (US)

(72) Inventor: Talar Terzian, Gainesville, FL (US)

( * ) Notice: Subject to any disclaimer, the term of this patent is extended or adjusted under 35 U.S.C. 154(b) by 241 days.

(21) Appl. No.: 15/902,472

(22) Filed: Feb. 22, 2018

(65) Prior Publication Data

US 2018/0245257 A1 Aug. 30, 2018

Related U.S. Application Data

(60) Provisional application No. 62/463,233, filed on Feb. 24, 2017.

(51) Int. Cl.
*D06F 37/14* (2006.01)
*D06F 37/30* (2020.01)
(Continued)

(52) U.S. Cl.
CPC ..... *D06F 37/145* (2013.01); *D06F 27/00* (2013.01); *D06F 37/30* (2013.01); *D06B 15/10* (2013.01);
(Continued)

(58) Field of Classification Search
CPC ..... D06F 37/30; D06F 13/04; D06F 58/08; D06F 2700/00; D06F 17/08; D06F 37/065; D06F 37/145; D06F 27/00
See application file for complete search history.

(56) References Cited

U.S. PATENT DOCUMENTS 3,638,799 A * 2/1972 Serowiecki ..... B01D 29/27 210/462
2003/0074932 A1* 4/2003 No ..... D06F 37/06 68/58
(Continued)

FOREIGN PATENT DOCUMENTS

CN 201043244 Y * 4/2008
CN 101805970 B * 5/2011
(Continued)

OTHER PUBLICATIONS

Machine translation of CN-104071002-A, dated Oct. 2014. (Year: 2014).*
(Continued)

*Primary Examiner* — Joseph L. Perrin
*Assistant Examiner* — Kevin G Lee
(74) *Attorney, Agent, or Firm* — Sandberg Phoenix & von Gontard, P.C.

(57) ABSTRACT

A spin cycle mobile washer (SCMW) for manually washing laundry comprises a portable, wheeled frame (F) supporting an axle (A) on each end of which is mounted a wheel (W). A shaft (RS) rotatably mounted on the axle rotates as the axle rotates. An inner wash tub (IWC) is mounted on a rotatable disc (RD) to which one end of the shaft is connected for rotation of the shaft to effect rotation of the tub. This tub has a plurality of paddles (P1-P3) attached to an interior surface so to agitate laundry to be cleaned which is loaded into the tub. This tub is fitted inside an outer wash tub (OWC) with the inner wash tub having openings therein by which water flows through and between the tubs for movement of the wheeled frame by a user to affect the cleaning of laundry.

4 Claims, 4 Drawing Sheets

(51) Int. Cl.

| | |
|---|---|
| ***D06F 27/00*** | (2006.01) |
| *D06B 15/10* | (2006.01) |
| *D06F 23/04* | (2006.01) |
| *D06F 37/12* | (2006.01) |

(52) U.S. Cl.
CPC ..... *D06F 23/04* (2013.01); *D06F 37/12* (2013.01); *D06F 37/14* (2013.01)

(56) References Cited

U.S. PATENT DOCUMENTS

2006/0054722 A1* 3/2006 Jones ..... A01C 17/001
239/663
2010/0281928 A1* 11/2010 Martin ..... D06F 39/024
68/213

FOREIGN PATENT DOCUMENTS

CN 103643448 A * 3/2014
CN 104071002 A * 10/2014
CN 101899760 B * 6/2015

OTHER PUBLICATIONS

Machine translation of CN-101899760-B, dated Jun. 2015. (Year: 2015).*
Machine translation of CN-201043244-Y, dated Apr. 2008. (Year: 2008).*
"Alachua students shine at state science, engineering fair," The Gainesville Sun, Apr. 8, 2015. (Year: 2015).*

* cited by examiner

SPIN CYCLE MOBILE WASHER

CROSS REFERENCE TO RELATED APPLICATIONS

This application is based upon and claims the benefit of U.S. provisional patent application 62/463,233 filed Feb. 24, 2017.

STATEMENT REGARDING FEDERALLY SPONSORED RESEARCH OR DEVELOPMENT

N/A

BACKGROUND OF THE INVENTION

This invention relates to a washing machine for washing clothes in areas that do not have electricity.

According to a Washington Post article, 1.3 billion people live in the dark including 57% of Africans. 7 out of 10 people in sub-Saharan Africa live without reliable access to electricity. 600 million Africans and 300 million Indians live their lives without access to the modern conveniences electricity affords those living in more developed nations. In areas without electricity, human power is used to complete daily chores that are performed using electricity or fossil fuels in more industrialized areas. Laundry, or the washing of clothes has been a part of everyday life for centuries. Before the advent of electricity, humans found various ways to clean their clothes including pounding them on rocks in rivers, to washboards in barrels, to hand agitators, to contemporary electric washing machines.

With the cost of electricity on the rise and the sheer lack of access to electricity in certain areas of the world, a low cost and effective non-electric mobile washer made from repurposed and recycled parts fills a void. By creating a washer that employs human foot/walking power to create the centrifugal and hydrodynamic shear forces needed to wash clothes, instead of electricity, one is able to provide clean clothes to those living in remote areas without electricity.

Lack of access to reliable electricity is not the only issue facing those living in these areas. The lack of time to do washing is a major issue as well. Having to do laundry by hand takes between to 3-6 hours a week to complete, and requires ones full attention and energy; not to mention the pollution washing creates in the streams where clothes are washed. Finding a way to effectively clean clothes without the use of electricity, gas, or fossil fuels, that allows the doer to multitask; e.g., walking from point a to point b would be a huge time savings. "If the doer could be washing on the way to the farmer fields and then use the water for the fields irrigation this would be huge due to water scarcity in Tanzania. It would be a major environmental savings and time savings since we have to often search for waterholes." (See the bibliography of Exhibit A in which references to all the cites herein are found).

According to research conducted by Andrew Erikson, John Gulliver and Peter Weiss, phosphate pollution is a major problem with respect to sewer water and ground water contamination. Phosphates, although removed from commercial laundry detergents in the U.S., are still found in products produced and sold in Africa and India. Eutrophication, or the enhanced production of primary producers resulting in a less stable ecosystem, is said to be the cause of toxic algae blooms and has been tied to phosphate run off. Phosphates are known to be primary contributors to excessive algae bloom growth and cause an imbalanced relationship between producers and consumers; and, as such, "throws off" the entire ecosystem. To be able to filter off waste water effectively would reduce ground and water contamination. In off-the-grid living conditions, the reduction of the use and consumption of electricity and other pollutants is essential.

This has led the inventor to design a new type of non-electric, centrifugal force, paddle agitated, cart-based washing machine, as described hereinafter, with a strong hydrodynamic shear force capable of removing or reducing stains from clothing, and which incorporates a water filtration system to reduce ground contamination from the waste water produced during washing.

An early attempt (circa 1750's) at such a machine employed washing dollies or shafts that would spin and agitate the clothing inside a wooden barrel. Another agitator driven machine (circa 1790's) was created by a British company. Referred to as the "Yorkshire Maiden", this machine had a plank that one spun, and as it was spun, there would be churning of the inside of a barrel where soap and clothes were mixed together. This was a non-electric version of modern-day center agitator driven washing machine. William Blackstone created a manual machine consisting of a wooden tub with a set of wooden pegs inside of it that one would fill with hot soapy water. As a handle was then turned, the clothes were caught on the pegs as a way of cleaning them. This machine was also a precursor to modern center agitator designs.

Another off-the-grid washing machine design, called the GiraDora, is made of a plastic tub. A second tub, formed by a colander-like drum is installed inside the outer tub, is mounted on a center post which is connected to a pedal that is used to turn the inside mechanism, agitating the water. After washing, water is drained from the tub and a spin feature, created by turning the inside drum, spins water off the clothes.

This, and other research of manually operated agitators, has proven critical to the inventor developing the washing machine of the present invention. This machine, as described herein, includes a colander pivot vat with side whiffle ball paddles that allows water to rush in and out of the holes in the vat thereby stirring the clothing in a circular fashion.

After investigating ways in which washing machines function, the inventor decided to look into the benefits of leg power versus a crank or arm powered action to operate the machine. She found that the leg strength of the typical individual is seven times stronger than one's arm strength and use of leg power also has the advantage of providing more endurance. (Dean). Walking and pulling a cart based washing machine allows the rotational aspects of a seed spreader to run the washing machine and allows users to complete their laundry chores while travelling from point A to point B. (Dean)

The inventor continued her research by studying the mechanics of seed spreaders and how they employ centrifugal force as they spin seeds in an outward fashion. This included reflecting upon the mechanics utilized and finding the seed spreading disc mechanism used to distribute seeds in an outward fashion (i.e., broadcasting) and which would create a force that would also thrust clothes against the sides of a wash bin when the mechanism is adapted to move water and laundry instead of seeds. She also investigated the use of centrifugal force and circular motion and how their related forces could be used to move clothes and create a hydrodynamic shear force.

Another aspect that was investigated was the design, benefit and advantages of employing filtration using bio-sand with steel wool fibers for the resultant gray water. A report published by the Swiss Federal Institute of Aquatic Science and Technology (Eawag), entitled *Greywater Management in Low and Middle-Income Countries, Review of Different Treatment Systems for Households or Neighbourhoods*, discusses how countries are learning to deal with water sanitation issues to improve water quality. Using this information, the inventor found that adding a gray water sand filter to her washer provided a viable way to recycle the water after it had been used to wash clothes. According to the Canadian Samaritan's Purse YouTube video "How the BioSand Water Filter Works—Samaritan's Purse CANADA", the type of filter found to be capable of doing this for a do it yourself (DIY) user was a slow Biosand and rock filter used with a diffuser plate. The way this filter works is that water enters a small reservoir and then passes through the diffuser plate which more or less evenly distributes the water across the sand. After passing through the sand and a steel wool fiber mixture, which traps impurities, the water flows downwardly into pea sized gravel, and then into a larger sized gravel. From there, the water flows out through a hose. This water can now be captured for re-use, possibly for subterranean irrigation in countries in Africa and India where there is currently no legal prohibition governing re-use of gray water.

After completely researching every aspect of her washing machine project, including the benefits that certain elements present with respect to agitation, water flow, hydrodynamic shear force, centrifugal force, and filtration, the inventor has become confident in her ability to develop an off-the-grid laundry system that will effectively clean clothes without the use of electricity or other expensive equipment.

SUMMARY OF THE INVENTION

The engineering goals for the inventor's mobile washing machine called the Spin Cycle™ include:

1. Uses no electricity or fossil fuel to run.

2. Is made from recycled or repurposed everyday items with at least 75% of all the machine parts being acquired from cost free sources.

3. Cost less than $15 (in 2017USD) for new, non-recycled parts such as a seed spreader base that will create a hydrodynamic shear force agitation using a treadle powered washer. This is tested by Tablet shear force/dissolution/erosion tests.

4. Removes more stains from a cotton fabric than a center agitator electric washer using a spin cycle seed spreader powered washer. This capability is tested by applying color gradient measurements to a stain remaining in the fabric after washing.

5. Utilizes filtered wash water by employing a bio-sand-steel wool-mesh and screen designed filter to lower phosphate levels of the waste wash water consisting of tomato sauce, water and Surf Excel™ which is a phosphate laden laundry detergent diluted by at least 5 mg/L. This allows the waste water to be used for irrigation in many African countries, and India, where re-use of greywater is not prohibited. Testing of the waste water is done using an API Phosphate level freshwater test kit.

Expected outcomes from use of this technology and components include:

1. Designing, drawing and building a washing bucket system using a colander-like inner bucket having paddle-like extensions which pivot on a central support driven by a rotational seed spreader mechanism. This mechanism is mounted within a second, outer bucket so water flows freely when agitated through the colander-like holes formed in the sides and bottom of the inner bucket, as the inner bucket is spun. The results in creation of a centrifugal force that pushes the clothing against the paddle-like extensions and bottom bumps, this creating water movement through the holes as the chamber/wash tub rotates.

2. Designing, drawing and constructing a water filtration system adapted to receive the wash water and filter out any phosphates in it by at least 5 mg/L. This is done to reduce the overall concentration of phosphates in the waste water and prepare the waste water for re-use or dumping. This further involves use of a bio-sand filter using 000 grade steel wool fibers, creek pea gravel, coarse sand, fine sand, a plastic diffuser plate with concentric circle holes punched in the plate, and a steel mesh splatter screen. All of these components are contained in a bucket having an outlet spout to which a hose is attached.

Other objects and features will be in part apparent and in part pointed out hereinafter.

BRIEF DESCRIPTION OF THE DRAWINGS

The accompanying figures, together with detailed description which follows, form part of the specification and illustrate the various embodiments described in the specification.

Corresponding reference characters indicate corresponding parts throughout the several views of the drawings.

DESCRIPTION OF A PREFERRED EMBODIMENT

Figure 1:
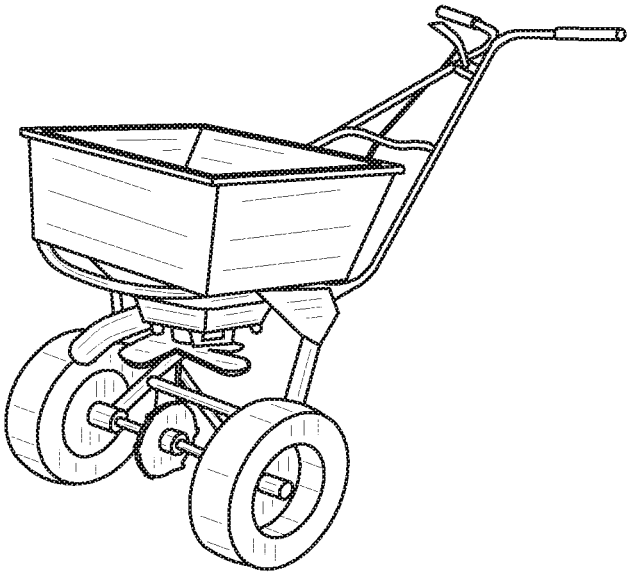
FIG. 1 is a perspective view of a seed spreader.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Section 1

Development of spin cycle mobile washer, hereafter "SCMW".

A heavy duty seed spreader such as shown in FIG. 1 was the inspiration for the rotational base of the design. The rotational mechanism used to broadcast seeds does so by throwing the seeds in an outward circular pattern which also provides the centrifugal force needed to move clothes in an outward circular pattern against the outer walls of the wash bucket.

Figure 2:
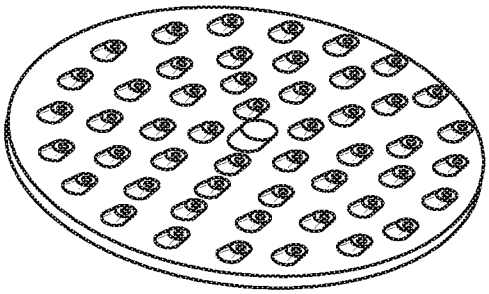
FIG. 2 is a perspective view of a showerhead.
Figure 3:
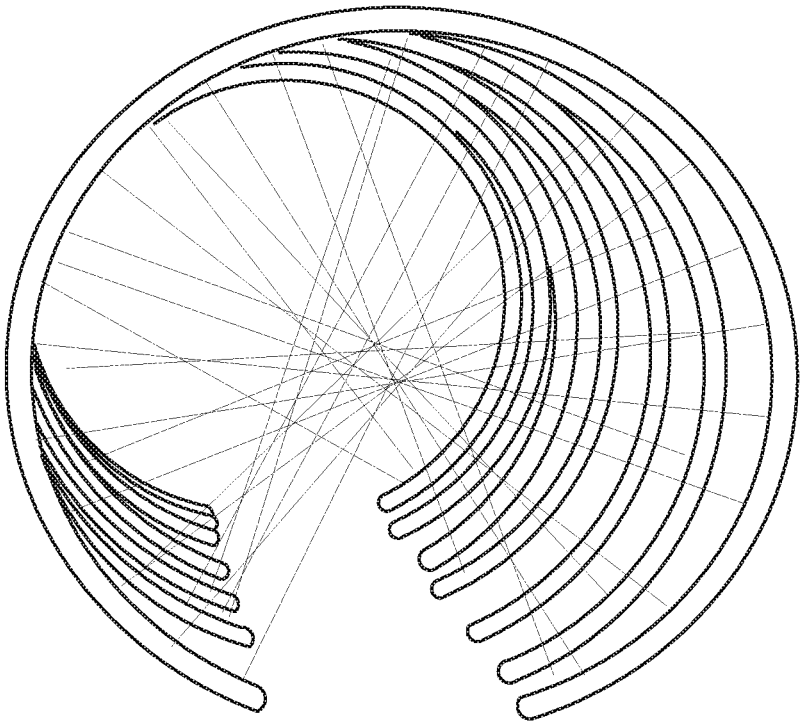
FIG. 3 illustrates a waterpark sprinkler head.

The inner wash tub design resulted from observations of both showerheads and waterpark sprinkler heads as respectively shown in FIGS. 2 and 3. The concept of water flowing in multiple directions with a certain amount of pressure was instrumental in the design of the wash tub.

Figure 4:
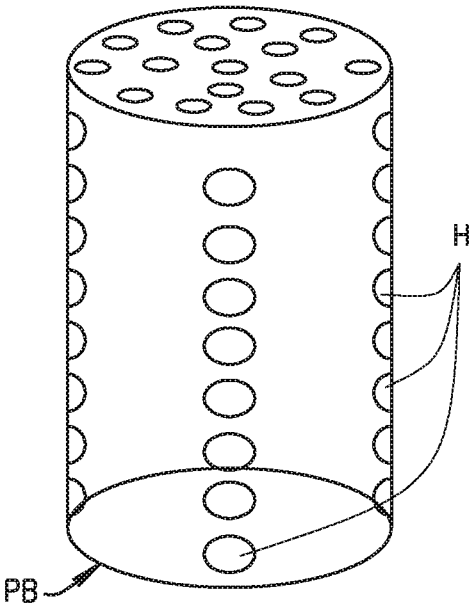
FIG. 4 illustrates a plastic bucket with holes drilled into the sides of it to allow water to flow into the bucket.

An examination of various sized whiffle balls and their placements was conducted. As shown in FIG. 4, the first idea for the washer tub design was inspired by a plastic bucket PB with holes H drilled into the sides of it to allow water to flow into the wash bin and come in contact with the clothes. This initial concept proved to create too little shear force in that the hole size created a unidirectional water flow that had too little pressure.

Figure 5:
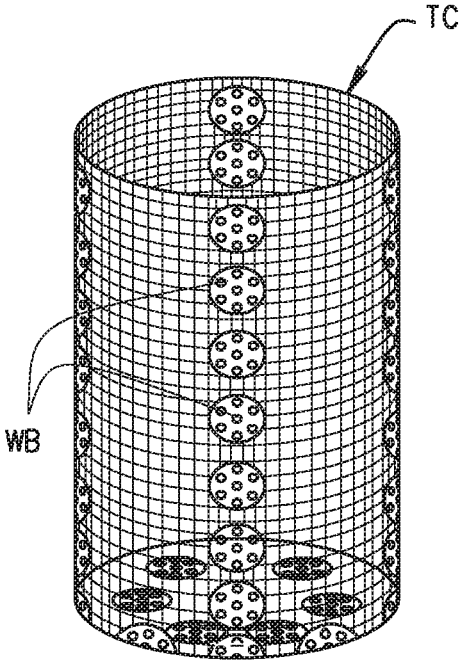
FIG. 5 is a representation of a wire mesh trash can with whiffle balls attached.

Referring to FIG. 5, a modification of this idea involved implementing a wire mesh trash can TC with whiffle balls WB attached. This idea was also discarded because the openness of the wire mess would not allow sufficient pressure to build up so that the water would come in contact with the clothes in a forceful manner.

Figure 6:
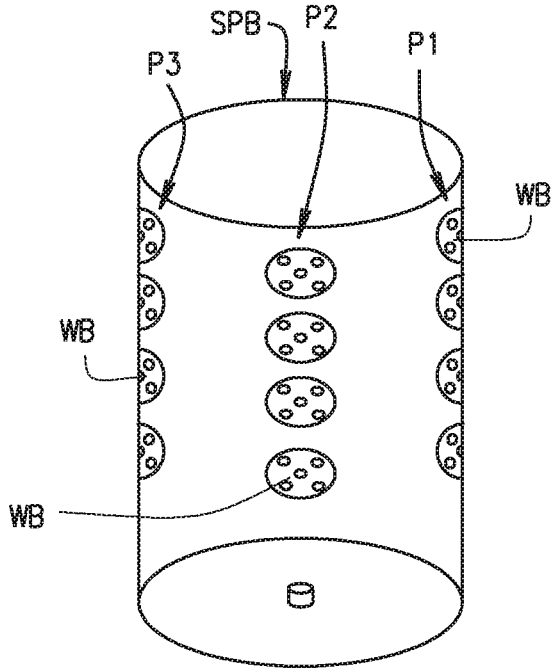
FIG. 6 illustrates a solid plastic bucket with whiffle balls attached to the interior sidewall side of the bucket to create paddles, each ball having a hole drilled behind it so water can flow through the ball from an outer wash chamber.

As shown in FIG. 6, additional modifications made to the design included the replacement of the wire mesh can with a solid plastic bucket SPB with baseball sized whiffle balls WB attached to the interior sidewall of the bucket to create 3 paddles P1-P3 with each ball having a hole drilled behind it so water could flow through it from the outer wash chamber.

This design yielded better flow due to whiffle ball placement and the solid core bucket. Yet it still would potentially trap clothes in the bottom of the bucket without having the ability to move them or force them to come into contact with additional water flowing from beneath.

Figure 7:
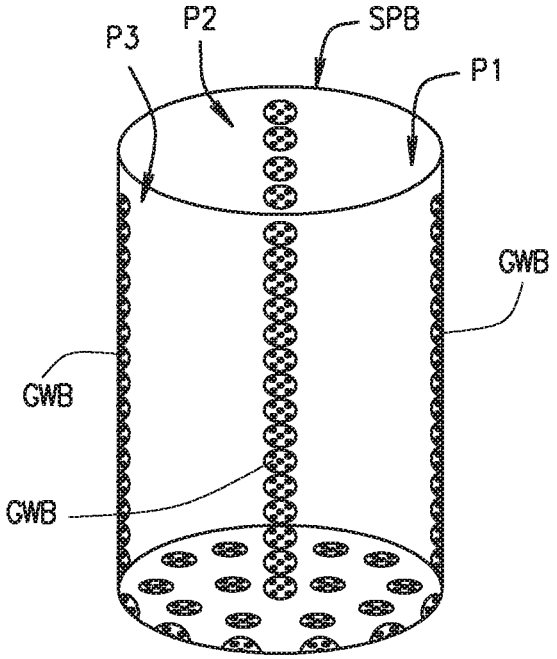
FIG. 7 is similar to FIG. 6 but illustrates a solid plastic bucket with golf ball sized whiffle balls attached to the interior sidewall side of the bucket to create the paddles.
Figure 8:
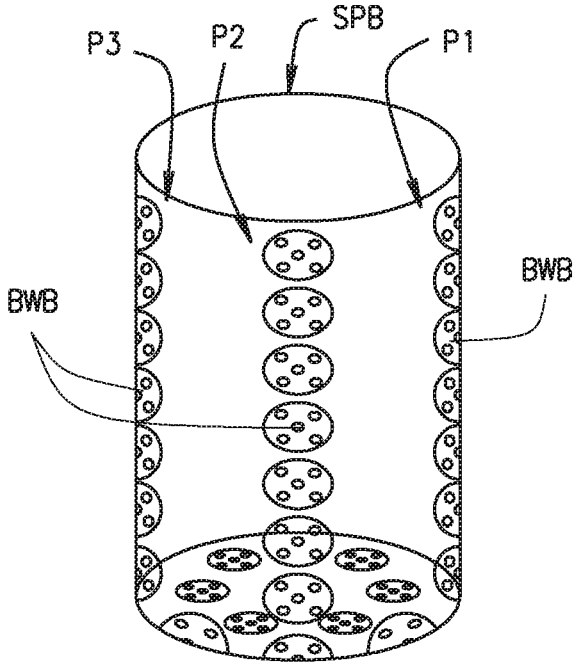
FIG. 8 is also similar to FIG. 6 but illustrates a solid plastic bucket with baseball sized whiffle balls attached to the interior sidewall side of the bucket to create the paddles.

Additional design changes, as shown in FIGS. 7 and 8, included using both golf ball size whiffle balls GWB (FIG. 7) and baseball sized whiffle balls BWB (FIG. 8) to see which would create a better hydrodynamic shear force and move the clothes more when under centrifugal pressure. The baseball size whiffle balls BWB were found to create a better flow-to-pressure ratio and tumbling of the clothes than using golf ball sized balls GWB.

Figure 9:
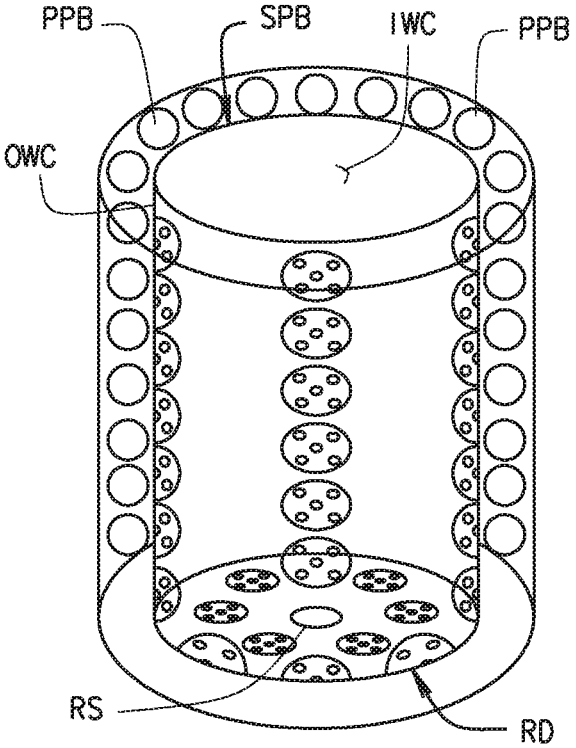
FIG. 9 is a representation of a clothes washer of the present invention having inner and outer wash chambers separated by ping pong balls.

Additional considerations for stabilizing the washer were considered. One thought was to separate an inner wash tub or chamber from an outer bin or chamber using ping pong balls PPB to stabilize the sides of the washer. This proved to be detrimental to the spinning ability of the inner wash bin, as it created unwanted friction. As such, this idea was discarded in favor of using a rotational disc RD attached to a rotational shaft RS, as shown in FIG. 9, to support some of the weight of the interior wash tub. An inner wash chamber IWC, separated from an outer wash chamber OWC by the ping pong balls PPB, was discarded in favor of the chambers being separated by water flowing through the holes H in the inner wash chamber into the outer wash chamber.

Figure 10:
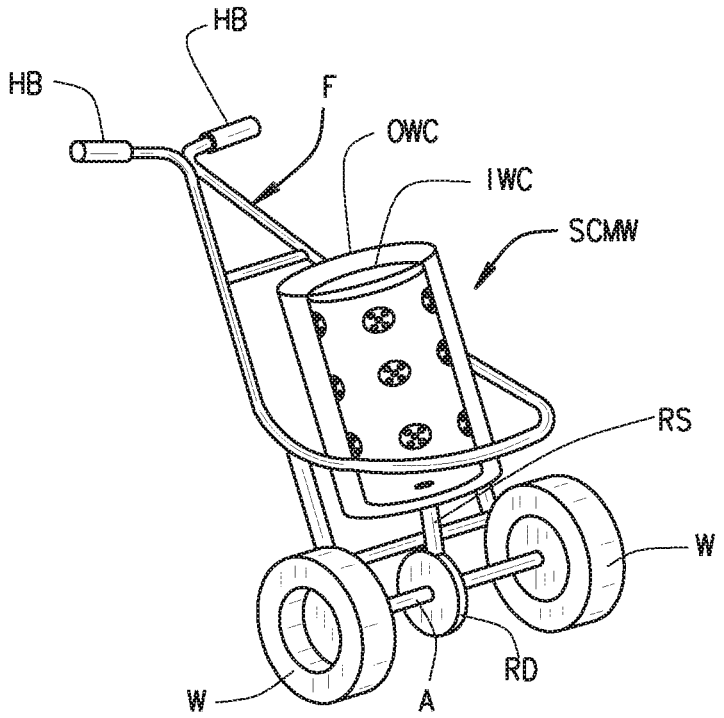
FIG. 10 is a representation of the final spin cycle mobile washer (SCMW) design; and, FIG. 11 is a representation of the SCMW design with a screen filter attached.
Figure 11:
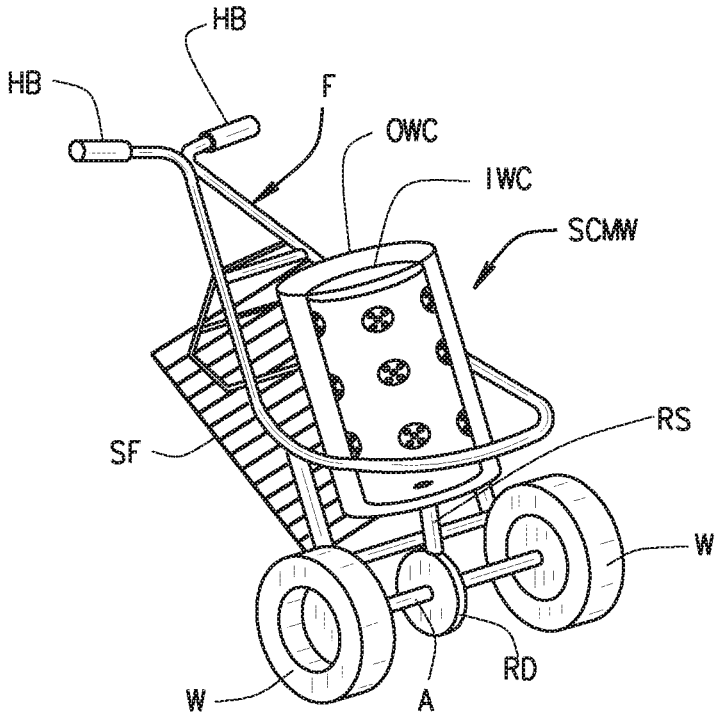

Referring to FIG. 10, the final SCMW design is shown. In FIG. 10, a portable wheeled frame or support F has two wheels W mounted on an axle A. The shaft RS is rotatably attached to the axle attached to effect rotation of disc RD and rotate inner wash chamber IWC with respect to outer wash chamber OWC. As the chamber rotates the paddles made from the baseball sized whiffle balls BWB affect agitation of the clothes to which results in their being cleaned. To enhance this final design, a bio-sand and steel wool and a mesh screen filter SF is fitted to the back of the washer as shown in FIG. 11.

In operation, laundry is placed in the inner wash chamber IWC and a source of water is used to fill the chamber together with whatever laundry detergent may be used. Thereafter, by pushing the handlebars HB on frame F one causes the frame to move which results in the inner wash chamber IWC rotating and causing the items placed in it to be agitated by the paddles P1-P3. The water and detergent mixture flow out from the inner wash chamber IWC to the outer wash chamber OWC through the holes H formed in the solid plastic bucket SPB at the location of the whiffle balls. The frame is pushed about as long as is considered necessary to clean the items being washed after which they are removed from the SCMW.

Section 2

A materials list for making a SCMW includes:

Washer Parts:

1 Used 100 lb weight Seed Spreader Base with a rotational mechanism
2 plastic buckets
1 bucket lid
1 rectangular shaped "kitty litter" type bucket with lid
Baseball size whiffle balls
Golf ball size whiffle balls
10.16 cm cable ties
1 30L plastic bucket
1 Metal faucet spigot
2 Threaded plastic pipes each with an on/off valve spout
1 meter length of hose
#000 Grade Steel Wool
Washed creek pea gravel
Coarse sand
Fine sand
Recycled metal splatter screen
Recycled plastic laminate
Hose clamps The tools required for constructing the invention include:

1 Cordless drill with hole saw bits and regular bits
1 Jigsaw
1 Circular saw
Pliers
Vise grips
Vise
Kitchen knife
Screw drivers
Mask
Goggles
A 2 part epoxy compound
Hole punch
White cotton t-shirts
Distilled water
440 mL of Tomato Sauce
1 Adobe® Photoshop® created color gradient scale
Afresh™ powder tablets 1 (150 tests) API Phosphate Freshwater Test Kit
Surf Excel™ powder detergent
Ear plugs
Gloves
Sharpie® color pen or marker
Bungee® cords Section 3

Construction of a SCMW is as follows with respect to the inner bucket IWC:

Step 1: Cut each of nine baseballs size whiffle balls BWB and nine golf ball size plastic whiffle GWB balls in half. This is done by securing each ball in a vise and then cutting on the seam of each ball with a kitchen knife.

Step 2: Using a Sharpie® pen, divide the bucket into thirds by marking off each section with the pen. Drill four holes H down each of the marked off sides of the bucket at equally spaced distances directly below the striped horizontal lines. This is done using a drill with a ¼" drill bit.

Step 3: Using the drill with a hole saw bit, drill a hole in-between each set of the smaller (i.e., ¼" diameter) holes down the three sides of the inner bucket.

Step 4: Using the four 10.16 cm cable ties, attach three of the baseball size whiffle balls, at equally spaced distances, in a vertical line down the inside of the plastic bucket. Repeat this step two more times to effectively create three equally spaced paddles at one-third intervals on the inside wall of the inner bucket.

Step 5: Attach three of the golf ball size whiffle balls GWB, using four 10.16 cm cable ties, at equally spaced distances on the inner bottom of the tub, so to produce a triangular shaped pattern of balls.

Step 6: Using a drill with a 22 mm hole saw, on the bottom of the inner bucket, drill three equidistantly spaced holes forming a triangular pattern below where the 3 golf size whiffle balls GWB are positioned on the inside of the bucket.

To complete the SCMW assembly:

Step 1: Remove the seed spreading bin from a used 100 lb seed spreader using a screwdriver and set the bin aside.

Step 2: With a reciprocating saw, cut-off and remove the plastic rotational seed spreading disc. Save the rotational disc, leaving visible the shaft connected to the rotational device.

Step 3. Modify a copper faucet to connect the rotational spinner to the wash bucket. First, cut off the spout part of the faucet and discard it. Next, remove the faucet handle with a screwdriver leaving the copper connection intact so that the rotational shaft from the spreader can pass through it and be attached to the inner wash chamber using the threaded pipe connections. This allows the rotational shaft RS to pass freely through the outer wash bucket for it to then be used to drive the spinning motion of the inner wash chamber. Discard the faucet handle.

Step 4: Attach the outer, solid bucket to the seed spreading rotational mechanism using the modified faucet attachment to create a water tight seal for the rotational shaft to pass through and that allows the interior wash tub to connect and spin while the outer bucket remains stationary.

Step 5: Before attaching the interior wash bin, slide the rotational disc down over the shaft and the faucet attachment. Then screw down the top part of the faucet attachment to secure the faucet assembly to the rotational disc.

Step 6: Place the washer tub on top of the rotational disc assembly and secure the pieces together using 3 screws. This now allows the tub to turn freely and securely.

Step 7: Using hose clamps, attach the wire basket rack to the tub from below the tub. The hose clamps securely hold the washer in place and secure it to the seed spreader frame.

Step 8: Place the lid on the assembly and drill a hole through the outside wall of the outer bucket and attach the spigot to the assembly, tightening the spigot to the bucket using two rubber washers. Attach the hose to the spigot.

To form the SCMW water filter assembly:

Step 1: Using hose clamps and bungee cords, secure a used baking rack to the bottom bars of the seed spreader base to hold the filter assembly.

Step 2: Using a drill with a 22 mm hole saw, drill a hole in the bucket, 4 cm from the bottom of the bucket. Attach the 1.75 cm threaded valve and pipe to the bucket at the location of the hole using a plastic nut a washer.

Step 3: Next form a 4 cm layer of washed creek pea gravel on the bottom of the bucket, leaving the spout area free.

Step 4: Cut a piece of mesh screen and secure the screen over the spout hole to keep pieces of gravel and sand out. Secure the mesh screen over the hole with an elastic rubber band.

Step 5: Form a 3 cm layer of coarse sand over the top of the pea gravel.

Step 6: Place a 1 cm layer of the 000 grade steel wool fibers, weighing 25 grams, on top of the coarse sand mixture. The steel wool needs to be presoaked in water for 1 week prior to its use to initiate rusting of the steel wool.

Step 7: Place a 4 cm layer of fine sand on top of the layer of steel wool.

Step 8: Using a recycled steel mesh splatter screen, cut it to fit, and place the steel mesh on top of the fine sand.

Step 9: Create a diffuser plate out of a piece of recycled plastic laminate by punching holes in the plate in a concentric circular pattern. Place the plastic diffuser plate on top of the mesh screen.

Step 10: Attach a 1.75 cm diameter plastic hose to the nipple reducer for drainage.

Step 11: Using bungee cords, attach the water filter to the back of the washer cart on top of the secured baking rack.

Section 4

After a SCMW is made in accordance with the above was completed, various tests were conducted to evaluate the machine's performance. These included the following:

1. The first test to be conducted is a shear force test and was performed to demonstrate the difference in shear force created by the invention compared to that of a treadle powered agitating washer. The test was a dissolution or erosion test done to demonstrate how water moves with a force sufficient to shear off stains. Using a powder tablet dissolution test in which 1 hard Afresh™ Powder Tablet was placed in 14 liters of water at 20° C., while keeping constant the number of steps made (i.e., 200 steps) and an agitation time of 2 minutes. The tablet was weighed before the test and then again 24 hours after the test, once it was dry. This was done to see how much of the tablet had eroded or dissolved away, this providing a measurement of the respective shear force produced by each washer. The test was conducted 30 times for each of the two washers being compared; i.e., the SCMW and the treadle washer. The resulting datasets are evaluated for normality (in order for the t-test to be applicable) and randomness (so checking the data for unusual behavior which would suggest 'special cause' issues during testing). Normality and randomness of the data are assessed using histograms and run charts; i.e., to check for randomness in the data by looking for data trends, outliers and lengthy runs, as well as t-tests to determine how a coincidental cause should be analyzed. A t-test is also performed to see if the mean values differ in a statistically significant way. These tests will be recorded in graphs and charts and then analyzed. Photos of the results were taken as well.

2. The second test is a washing test, in which 60-100% cotton t-shirt samples soaked with a solution of 440 mL of tomato sauce mixed with 5L of water. Soaking is for 10 minutes in a 18.9 L bucket. Each shirt is then photographed. Two (2) tomato stained t-shirts at a time are placed into the SCMW along with 20 g of Surf Excel detergent, and 15 liters of water. The shirts are then subjected to a 10 minute wash cycle and 5 minute rinse cycle. The shirts are then removed from the washer and laid on a flat surface for 24 hours to dry. This process is repeated 4 more times. Six specific locations on each t-shirt (top right-front, center-front, bottom left-front and top right-back, center-back and bottom left-back) are measured by applying color gradient scales (average of 5 people's view), and the color changes are recorded to see how close to the original white of each t-shirt the 60 samples came, this being done using a color gradient created by locking in the initial color stop from the original, untreated tomato sauce and then pulling the color through a color gradient creator in Photoshop™ Cs6 to establish 25 color stops. These steps are repeated for the treadle washer's samples and for an Estate Electric Washer samples as well. All of these are done using the same ratio of wash water detergent to water and the same amount time is spent for washing-agitating, rinsing, and drying. Mean and standard deviations are calculated for each of the washers, and each of the datasets are evaluated for normality (in order for the t-test to be applicable) and randomness (so checking the data for unusual behavior which would suggest 'special cause' issues during testing). Normality and randomness of the data is assessed using histograms and run charts, to check for randomness in the data by looking at data trends, outliers and lengthy runs, as well as t-tests to determine how a coincidental cause is to be analyzed. A t-test is also performed to see if the mean values differ in a statistically significant way and the results are compared to each other. The test samples are photographed, analyzed and recorded in charts and graphs.

3. The third test is for phosphate levels in the filtered wash water produced by the SCMW's filter using a bio-sand steel wool filter versus unfiltered wash water using an API Phosphate Freshwater Test Kit. Samples of the detergent water both filtered and unfiltered from 25 different washes are tested to ascertain their levels of phosphates. Readings are recorded in a logbook and the data is graphed. 5 mL of unfiltered wash water is and measured against a gradient phosphate level card provided with the test kit. 25 samples from 25 different batches are tested. Samples of the filtered wash water of 5 mL each from the same 25 batches is taken from the final pour of the filter to allow maximum contact time with the filtration medium. The samples are each measured against the color gradient phosphate card. Tests for normality and randomness and t-tests are run to assure accuracy of the differences in mean values. Tests for randomness and normality including histograms, run charts looking at data trends, outliers and lengthy runs, as well as t-tests to determine cause from coincidence are analyzed and the results recorded in charts and graphs.

Section 5

Risk and Safety Assessment:

Risks:

1. Potential risks or hazards associated with the use of power tools are: electrical shock, noise, vibrations, cuts, puncture wounds, limbs being severed, dust, inhalation of foreign particles, loss of eyesight due to flying debris.

2. Potential risks associated with the API Phosphate Test Kit include: burns, eye irritation and inhalation of vapors, may cause damage to organs with prolonged use.

Safety:

1. Adult supervision and training for all power tools (drill, jigsaw, circular saw) used in the construction of the washing system is provided at all times. Adult supervision with the chemicals in the Phosphate test kit is also provided.

2. Understanding the proper handling of electrical equipment and the risks of shock and the potential dangers of power tools such as: cuts, blood loss and the potential for limbs to be severed or maimed is essential. Understanding the proper handling with the chemicals Phosphate Solution #1 and #2 and the risks of skin burns and irritation, eye damage and irritation and inhalation risks is also essential.

3. Specific training on the correct operation of the power drill, circular saw, and jigsaw will be provided by skilled craftspeople.

4. Safety goggles and or safety mask and ear plugs are worn during the operation of all power tools, Power tools are plugged into grounded outlets. Blades are tightened and checked for tightness and proper rotation. Safety goggles, mask and gloves are used during Phosphate testing. Testing is performed in a well ventilated area.

5. Videos from the Power Tool Institute will be watched.

6. SDS Sheets on laundry detergent and the two Phosphate #1 are consulted and safety precautions including masks, gloves and ventilation are used Section 6

Various initial building problems and design modifications for the washer included:

The initial idea and trial prototype incorporated a wire mesh trash can with whiffle balls attached, but this version was quickly discarded as it was thought the design needed to make the water move sufficiently to create a hydrodynamic shear force. The wire mesh would not create the type of pressure chamber needed to force the water through the clothes, since it would have no walls to contain the water or project water up against. Accordingly, a solid trash can replaced the wire mesh trash can.

During washer construction, the golf ball sized whiffle balls did not produce as much hydrodynamic shear force as the baseball sized whiffle balls. A rough examination of the way in which water flows through each type of ball was done to visibly and tactilely note differences in water output. Although Bernoulli's principle suggests that the greater the flow the lower the pressure, it follows that there must be a balance between flow and pressure to adequately remove stains. One needs both the right amount of water hitting the clothes with the right amount of pressure being produced. During initial testing, golf ball size whiffle balls did not allow as much water to come in contact with the clothes. The spray stream created was too thin; whereas the baseball sized balls allowed a greater amount of water to come into contact with the clothes with a strong enough pressure to remove stains.

Another problem that arose was how to get the inner wash bucket to rotate within the outer wash bucket without causing a leak in the outer bucket. This was solved by retrofitting an old faucet with a shutoff valve that would allow the rotational shaft of the spreader to pass through the pipe and valve, and to seal around the stem shaft of the rotational arm.

To stabilize the wash buckets the inventor had to create a shelf that would support the water filled washer and not interfere with the drain spout that connects to a hose that goes into the filter. This problem was solved by using a wire shelving that had holes in it and which was cut it to fit and when in place function as a support mechanism.

Since the washer was built out of recycled and repurposed materials, the inventor had to modify the height of the inner wash bucket so the lid of the entire unit could be secured to cover both the outer and inner wash buckets so to prevent splashing.

The bio-sand and steel wool filter also required retrofitting since the weight of the filter had to be borne by the cart. An old metal baking rack was fashioned to fit onto the bottom of the cart with hose clamps to support a recycled kitty litter bucket and its lid and in which is housed the filter.

An initial problem with the inner wash bucket construction was how to fasten the whiffle balls in such a way they would not have sharp edges, or catch on the clothes. The goal was to create a smooth tumbling surface that would aid in movement of the clothes, rather than hindering the movement. Zip ties were used to attach the balls and their closures were turned to the inside of the whiffle balls so to have a smooth connection.

The initial design also lacked balls on the bottom of the inner wash bucket, but this soon became evident as a design flaw to be remedied because the bottom did nothing to promote water flow or clothes movement. Rather, this flaw made the bucket function more like a pit. With the addition of the golf ball sized whiffle balls attached to the bottom together with their respective water holes, the clothes began to bump along the bottom of the tub or vibrate due to the pits and humps in the surface the addition of the balls created. The added water holes also served to promote additional water movement from below.

Another issue that arose was the need to increase the spin of the wheels so they could turn with less friction and spin quickly. Applying a grease to the wheel axles allowed them to turn more freely and produce the desired result.

Section 7

Summary of Test Results and Data Analysis:

As with any study in scientific or engineering research, the validity and reliability of the test results is paramount. In this instance, the test results need to be reflective of washer performance. Accordingly, test trials were repeated to ascertain that the variation of outcomes demonstrated random variation around a central tendency representing washer performance. Non-random outcomes (e.g., outliers, runs, trends) indicate other than the washer system is being tested; and if present, could influence the results and potentially lead to erroneous conclusions. For instance, if one accidentally recorded what should have been a 12.2 reading as a 122.0 reading this would be identified in a non-randomness check. Or, if the tablet dissolution were to steadily increase across the trials of the washer design, then something outside of "pure" washer performance would be affecting it; e.g., like time which may be correlated with tablets absorbing humidity pre use and therefore are easier to dissolve. As such, this occurrence would have nothing to do with washer performance but, rather test preparation/setup etc. So, with these caveats, it is essential to examine the data for both normality and randomness prior to considering the vast difference in means for each of the following respective tests.

Results of the Afresh Tablet Hydrodynamic Shear Force Test:

In this test, a non-agitated control was employed along with the two agitating washers—the SCMW and the treadle washer. The control had a mean average change of 0.327 g, demonstrating a miniscule change in weight for the tablet. The SCMW had a mean average change of 12.241 g and the treadle washer had a mean average change of 5.334 g. A t-test comparing the change in the non-agitated control to the change in the SCMW's tablet weight revealed a t-stat of 377.6142 and a t-critical value of 2.0129, suggesting a true difference in performance due to agitation and washer design. The P-value of 5.81 E-82 indicates that there is an infinitesimal chance that the difference in mean is due to randomness. Data was analyzed for normality and randomness sampling using a histogram which showed one central hump with two tails, and as such, which suggests a normal distribution (allowing use of the t-test). A run chart for non-randomness was also evaluated. No outliers were found, no lengthy data runs were exhibited, and no evidence of data trends were seen. These all indicated that the data did not exhibit non-randomness.

A t-test was performed for the SCMW and the treadle washer to compare agitation levels and change in weight of the tablet that occurred with each. The t-stat value was 150.2518 and the t-critical value was 2.0075. The larger t-stat value indicates that the true difference in performance is due to agitation and washer design. The P-value of 3.52 E-69 indicates that there is an infinitesimal chance that the difference in mean is by random chance. Data was analyzed for normality and randomness sampling using a histogram which had either one hump and two tails in case of the treadle washer or was right skewed and had one hump and one tail which was the case of the SCMW both of which are considered normal. A run chart for non-randomness was produced for each run. No outliers were found, no lengthy data runs were exhibited, and no evidence of data trends were seen; all indicating the data did not exhibit signs of non-randomness. Based on this, it is concluded that the SCMW possesses a greater hydrodynamic shear force; this being demonstrated by its better than 7 gram average tablet dissolution mean over the treadle washer and by its nearly 12 g average tablet dissolution mean over the non-agitated control.

Results of the Color Stop Stain Remaining Test:

For the Color Stop Stain Remaining Tests both normality and randomness tests were performed. A histogram was used to check for relative normality in the data which for each washer showed either one hump and two tails or one hump and one tail right skewed. Further observations of the data for non-randomness via a run chart revealed that there were no statistical outliers (outside the +/−3 stdvs) for any of the 3 different washers. There were also no trends in the data for any of the 3 different washers. Although the SCMW did have a lengthy run there were only two data points that presented themselves and may simply suggest that the sample size of 60 was too small. Also the extremely high performance seen in the visual documentation via photographs of the samples suggests that it does not hold as a true indicator of non-randomness. Furthermore, the lengthy run may also suggest that the tool used to measure the color stop changes was not precise enough to capture the minute variations in the samples. The same data presented as normal as a right skewed histogram with its natural limits of the test that something cannot be whiter than white indicated by the lowest color stop value of 1. T-tests were performed comparing the means of the SCMW 1.22 color stops remaining and the Treadle Washer 2.39 color stops remaining. The absolute value of the t-stat (−10.5351) was greater than the t-critical value of 1.986377 indicating that it is highly unlikely that the 2 average means (SCMW 1.22 and Treadle Washer 2.39) were different by random chance, but rather that the means derive from the washer design. The p-value of 1.96 E-17 indicates that the probability of getting such a difference in mean between 1.22 and 2.39 by random chance is infinitesimally small. The 1.17 difference in the mean performance in stain remaining demonstrates a clearly stronger washing performance for the SCMW.

The SCMW's mean of 1.22 color stops and the Estate Electric Washer's mean of 13.7 color stops were also subjected to a t-test. The absolute value of the t-stat (−73.9863) exceeds the t-critical value (1.993943) indicating that it is highly unlikely that the 2 averages were different by random chance, but rather the mean difference stems from washer design. The p-value of 6.15 E-69 also indicates that the probability of getting such a difference in mean between 1.22 and 13.7 by random chance is infinitesimally small. So we can conclude the differences observed are due to washer performance related to design differences.

Results of the Phosphate Water Filtration Test:

Although we cannot determine the randomness of the unfiltered water due to the small sample size and specificity of the measurement limitations of the API Phosphate Level Freshwater Test Kit, the 25 samples of unfiltered wash water demonstrated a uniform minimum of 10 mg/L of phosphate with a standard deviation of 0. A strong limitation to the data is the level of specificity of the API Phosphate Freshwater test kit which has a scale that stops at 10 mg/L. What we can say with certainty is that the water samples tested each had at least 10 mg/L of phosphate since the high end of the testing range capped off at 10 mg/L. When it comes to the filtered water samples normality and randomness tests were conducted in the form of a histogram which revealed normality with its one hump and two tailed appearance. The filtered wash water possessed an average phosphate level of 0.76 mg/L which is 9.24 mg/L less than the unfiltered water mean of 10 mg/L. An examination for randomness in the form of a run chart that highlights outliers (outside +/−3 stdvs) found none, and also looking at whether there are lengthy runs in data which there were none, whether there were any indicators of trends in the data (there were none). All of these points suggest with confidence that the data possesses both stability and no evidence of special cause or influence. This indicates that the change in the filtered wash water data was due to the filter's construction and not by some force outside the system. A t-test was conducted on the means of both the filtered 0.76 mg/L and unfiltered wash water 10.0 mg/L. The t-stat at 224.5124 is much larger than the t-critical value at 2.068658 which demonstrates that the 2 averages compared were not different by random chance, but rather that there is a true difference caused by the filter design. By examining the p-value of 6.24 E-40 it is evident that the chance of getting the difference in the mean between 10 and 0.760417 is infinitesimally small.

Section 8

Conclusions:

Overall, the results of the prototype tests indicate the SCMW's superiority in creating shear force, reducing the visibility of stains, and filtering out phosphate from wash water better than the two units tested; i.e., the treadle washer and the Estate Electric Center Agitator Washer.

The difference in means between the SCMW and the treadle washer for the Afresh Tablet Shear Force test was +7 grams in favor of the SCMW, indicating the solid shear force and water movement advantages for this new device. The SCMW demonstrated≈12 gram shear force advantage over a non-agitated control, also reveals its superior power to move water.

The 1.17 mean color stop difference created between the SCMW and treadle washer during the Stain Remaining Color Stop test indicates the cleaning powers of the SCMW to be superior to those of the treadle washer. Moreover, a greater indicator of the cleaning potential that the SCMW is the 12.48 mean color stop difference the SCMW had over the Estate Electric Center Agitator Washer. That the SCMW was able to remove significantly more stain from a fabric under the same washing conditions as an electrically powered washer of a conventional design is a key factor suggesting further study of these design elements.

Although some conclusions may be drawn from the API Phosphate tests, this is perhaps the part of the washer design that warrants the greatest amount of future research due to its lack of specificity. A conclusion that can be drawn from the phosphate tests that were conducted is that the Bio-sand, steel wool fiber and screen mesh filter reduced the levels of phosphate in the filtered wash water to 0.76 mg/L of phosphate, reducing it by at least 9.24 mg/L. Although this does not lower the phosphate level to drinking water standards of 0.09 mg/L, it does reduce the amount of phosphate released into the ground by a significant amount.

In view of the above it will be seen that the several objects and advantages of the invention have been achieved and other advantageous results have been obtained.

What is claimed is:

1. A spin cycle mobile washer (SCMW) for washing laundry manually in areas where electricity is unavailable comprising:

a portable, wheeled frame having an axle supported by the frame with a wheel mounted on each end of the axle;

a shaft rotatably mounted on the axle to rotate as the axle rotates;

an inner wash tub mounted on a rotatable disc to which one end of the shaft is connected for rotation of the shaft to effect rotation of the inner tub by the rotatable disc, the inner wash tub having a plurality of paddles attached to an interior surface thereof to agitate laundry to be cleaned and which is loaded into the inner wash tub together with a cleaning detergent, each paddle of the plurality of paddles being hemispherical and comprising resilient plastic with a plurality of through-holes, wherein the inner wash tub comprises a solid plastic bucket in which a pattern of holes are made for attaching the hemispherical paddles to the inside of the tub, each paddle of the plurality of paddles corresponding to a hole of the pattern of holes; and an outer wash tub inside of which the inner wash tub is rotatably installed, the inner wash tub having openings therein by which water flows through and between the inner and outer wash tubs to separate the two wash tubs, whereby movement of the wheeled frame by a user affects the cleaning of laundry.

2. The SCMW of claim 1 in which the frame has handlebars to enable a user to push the SCMW about so that the inner wash tub rotates and the paddles agitate the items of laundry so the items are cleaned.

3. The SCMW of claim 1 wherein each hemispherical paddle of the plurality of paddles has a diameter of between 2.5 inches and 3.5 inches, inclusive.

4. The SCMW of claim 1 further including a filter screen attached to the frame to filter materials expelled from the SCMW.

* * * * *